US012723826B2

(12) United States Patent
Kroyer et al.

(10) Patent No.: US 12,723,826 B2
(45) Date of Patent: Sep. 1, 2026

(54) RECOIL SPRING ABUTMENT FOR A SLIDE OF A MODULAR HANDGUN

(71) Applicant: GLOCK TECHNOLOGY GMBH, Ferlach (AT)

(72) Inventors: Josef Kroyer, Zemendorf (AT); Alfred Urban, Bad Voslau (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 17/995,690

(22) PCT Filed: Apr. 1, 2021

(86) PCT No.: PCT/EP2021/058672
§ 371 (c)(1),
(2) Date: Oct. 6, 2022

(87) PCT Pub. No.: WO2021/204689
PCT Pub. Date: Oct. 14, 2021

(65) Prior Publication Data

US 2023/0138874 A1 May 4, 2023

(30) Foreign Application Priority Data

Apr. 8, 2020 (EP) ..... 20168815

(51) Int. Cl.
*F41A 3/86* (2006.01)
*F41A 11/02* (2006.01)
*F41C 3/00* (2006.01)

(52) U.S. Cl.
CPC ..... *F41A 3/86* (2013.01); *F41A 11/02* (2013.01); *F41C 3/00* (2013.01)

(58) Field of Classification Search
CPC ..... F41A 3/86; F41A 11/02; F41A 3/80–88; F41C 3/00
See application file for complete search history.

(56) References Cited

U.S. PATENT DOCUMENTS 4,031,808 A 6/1977 Raville
4,409,882 A * 10/1983 Blackshaw ..... F41A 3/34 89/137

(Continued)

FOREIGN PATENT DOCUMENTS

CN 201680763 U * 12/2010 ..... F41C 33/0245
FR 2805888 A1 * 9/2001 ..... F41A 11/02

(Continued)

OTHER PUBLICATIONS

Lone Wolf: Slide Adapter Installation for Glock. "Lone Wolf-2". <https://www.youtube.com/watch?v=zZY8aMMZdXE>. Feb. 24, 2016. (Year: 2016).*

(Continued)

*Primary Examiner* — Gabriel J. Klein
(74) *Attorney, Agent, or Firm* — Raven Patents, LLC; Anton E. Skaugset

(57) ABSTRACT

A recoil spring abutment for a slide of a pistol, the slide including slide grooves on both sides, and the recoil spring abutment being designed to be insertable and mountable in the slide and includes a preferably essentially semi-cylindrical base body having at least partially continuous guide rails on both sides, and an essentially circular step on a rear side for accommodating a recoil spring assembly. The invention also relates to a modular slide for such a recoil spring abutment, as well as to a slide cover sleeve, which may be mounted on the slide by means of the latter, and to the slide cover sleeve itself.

16 Claims, 8 Drawing Sheets

(56) References Cited

U.S. PATENT DOCUMENTS

| | | | | | |
|---|---|---|---|---|---|
| 4,514,922 | A * | 5/1985 | Farrar | F41A 9/65 | 42/50 |
| 5,717,156 | A * | 2/1998 | Lenkarski | F41A 3/64 | 89/196 |
| 6,401,379 | B1 * | 6/2002 | Moon | F41C 23/18 | 42/71.01 |
| 7,712,243 | B2 * | 5/2010 | Morando | F41A 9/65 | 42/108 |
| 8,925,239 | B1 * | 1/2015 | Cole | F41A 11/00 | 42/143 |
| 9,115,952 | B2 * | 8/2015 | Cole | F41A 11/00 | |
| 10,823,517 | B1 * | 11/2020 | Brandly | F41A 17/72 | |
| 11,067,350 | B1 * | 7/2021 | Shepard, Jr. | F41A 11/02 | |
| 2009/0071053 | A1 | 3/2009 | Thomele | | |
| 2017/0191769 | A1 * | 7/2017 | Martindill | F41A 3/86 | |
| 2017/0321980 | A1 | 11/2017 | Wolf | | |
| 2019/0154369 | A1 * | 5/2019 | Kim | F41A 3/66 | |
| 2023/0045746 | A1 * | 2/2023 | Amir | F41A 3/66 | |

FOREIGN PATENT DOCUMENTS

| | | | | | |
|---|---|---|---|---|---|
| GB | 201958 | A | 8/1923 | | |
| WO | WO-2008119098 | A1 * | 10/2008 | F41A 19/11 | |
| WO | WO-2012135880 | A1 * | 10/2012 | F41A 3/44 | |

OTHER PUBLICATIONS

Custom Glock 26 // Long Slide !?. "Lone Wolf-1". <https://www.youtube.com/watch?v=sJqnxPBN7VM>. Jun. 7, 2018. (Year: 2018).*

Bubits. WO 2012135880 A1. Machine Translation via <worlwide.espacenet.com>. Oct. 11, 2012. (Year: 2012).*

* cited by examiner

RECOIL SPRING ABUTMENT FOR A SLIDE OF A MODULAR HANDGUN

TECHNICAL FIELD

The present disclosure relates generally to firearms, particularly handguns, and more specifically to a recoil spring abutment for handguns and a modular slide for such a recoil spring abutment, and also to a modular concept for handguns.

BACKGROUND

A breech in the context of the present disclosure is understood to mean a blowback action for pistols, the term breech being understood essentially as a synonym for the term slide. In the following description, a number of other assemblies, such as the trigger group, safety elements, etc., are not explained in further detail since they are well known to the person skilled in the art.

Pistols have been popular as service weapons utilized by military personnel, law enforcement, and other emergency services sectors, as well as in the private sector. As a result, the various areas of application often require different pistol types or pistols with different external dimensions. For example, a pistol having relatively short dimensions, i.e., in particular a short barrel and slide length, is better suited for concealed carrying than is the case for competition shooting, where comparatively longer barrels or slides are usually used.

Only a few modular pistol systems are known and each require one or multiple central assemblies in order to be able to attach, for example, barrels, slides, receivers, etc. One example of thereof is US2009/0071053 A1, the content of which is incorporated by reference in the present application for the jurisdictions in which this is possible, in which a central trigger unit is described, which may be used in receivers of different sizes or heights and which cooperates with barrels or slides of different lengths.

However, the user may wish to use the same receiver for different purposes, i.e. also with the same integrated trigger system, with barrels of different lengths and/or slides. A similar case may arise where a user wishes to use a long barrel and/or slide, but wishes to combine it with receivers of different sizes. The smallest length of the slides is determined by the length of the support on the receiver, the length of the slide generally being greater than the length of the receiver.

Using the example of the popular pistol models of the GLOCK® brand, historically it may be difficult to combine different models of the same caliber. This is illustrated by the example of the combination of the relatively short receiver of a G19 pistol with a relatively long slide (and barrel) of a G34. When using the recoil spring assembly of a G34 or a G17L, a functional fusion to a pistol with G19 receiver and G34 barrel or slide length would take place, but a gap with a clear view of an exposed part of the recoil spring assembly would remain free and visible on the underside of the pistol between the spring support on the slide end at the muzzle and the front end of the receiver.

In US2017/0321980 A1, the content of which is incorporated by reference in the present application for the jurisdictions in which this is possible, an alternative way for the above-mentioned desired combination of gun assemblies or of a modular structure is described by providing a central trigger housing, which is suitable laterally as a guide for slides of different lengths and for mounting on receivers having different receiver lengths—similar to the above problem. However, since in this case the contact length to the slide is determined by the length of the separate trigger housing, the aforementioned problem of a gap in a slide with "excess length" would still exist. In addition, a separate trigger housing also means a significant increase in the total number of components in a pistol and in the risks associated therewith. This publication therefore discloses slides of different lengths which have recoil spring supports of different lengths that are integrally formed on the underside of the slide in order to rest flush with the trigger housing.

Such slides and recoil spring supports of different lengths are widely known to the person skilled in the art, the recoil spring supports being formed in one piece on the slide. However, this requires a relatively high outlay in terms of manufacturing and materials during manufacture.

The publication US2017/191769 A1, the content of which is incorporated by reference in the present application for the jurisdictions in which this is possible, deals with the problem, to use receivers of a young generation of GLOCK® pistols, eg G4 with slides of older generations, e.g. G3. They may be mounted and regularly used, but on the front end of such a combination, a ring-shaped slot exists around the spring support, what is unwanted, optically and due to the danger of contamination. In order to close that slot, it is recommended to provide a ring-shaped cover with a U formed lip between the front of the slide and round the spring. This ring is protected against rotation by the lip, but is positioned by the force of the spring only, and simply drops down when the gun is dismantled. It is absolutely inapplicably for the use with barrels with different lengths. There are proposals to form this adapter integrally with either the slide or the spring support, which contradicts the idea of a combination diametrically.

The object of the present disclosure may therefore be considered to be overcoming the existing problems in the prior art and to propose a concept for an improved modularity of existing pistols in order to be able to combine different barrel lengths and/or slide lengths with different receivers. Furthermore, there is the object of a time and material-optimized production.

These objects are achieved by a recoil spring abutment for the slide of a pistol, the slide having slide grooves on both sides, as described below.

SUMMARY

The present disclosure is directed to recoil spring abutments for the slide of a pistol, the recoil spring abutment being configured to be insertable and mountable in the slide. The present disclosure is also directed to modular slides for such recoil spring abutments, as well as to slide cover sleeves, which may be mounted on the slide by means of the latter, and to the slide cover sleeve itself.

In one example, the disclosure includes a recoil spring abutment for a pistol, the pistol including a recoil spring assembly and a slide having slide grooves on both sides of the slide. The recoil spring abutment is configured to be inserted and mounted in the slide, includes a substantially semi-cylindrical base body having at least partially continuous guide rails on both sides of the base body, and includes a substantially circular step on a rear side of the recoil spring abutment for receiving the recoil spring assembly.

In another example, the disclosure includes a modular slide for a pistol that includes a recoil spring assembly, where the modular slide includes slide grooves on both sides of the modular slide, and the modular slide is configured to accommodate a recoil spring abutment. The recoil spring abutment is configured to be inserted and mounted in the slide, includes a substantially semi-cylindrical base body having at least partially continuous guide rails on both sides of the base body, and includes a substantially circular step on a rear side of the recoil spring abutment for receiving the recoil spring assembly.

The disclosed features, functions, and advantages of the disclosed recoil spring abutments, modular slides, and slide cover sleeves may be achieved independently in various embodiments of the present disclosure, or may be combined in yet other embodiments, further details of which can be seen with reference to the following description and drawings.

BRIEF DESCRIPTION OF THE DRAWINGS

FIGS. 11A-11C show schematic illustrations of an exemplary slide cover sleeve and slide prior to installation (FIG. 11A), after installation (FIG. 11B), and in a sectional view along XI-XI' in FIG. 11B.

DETAILED DESCRIPTION

Figure 1:
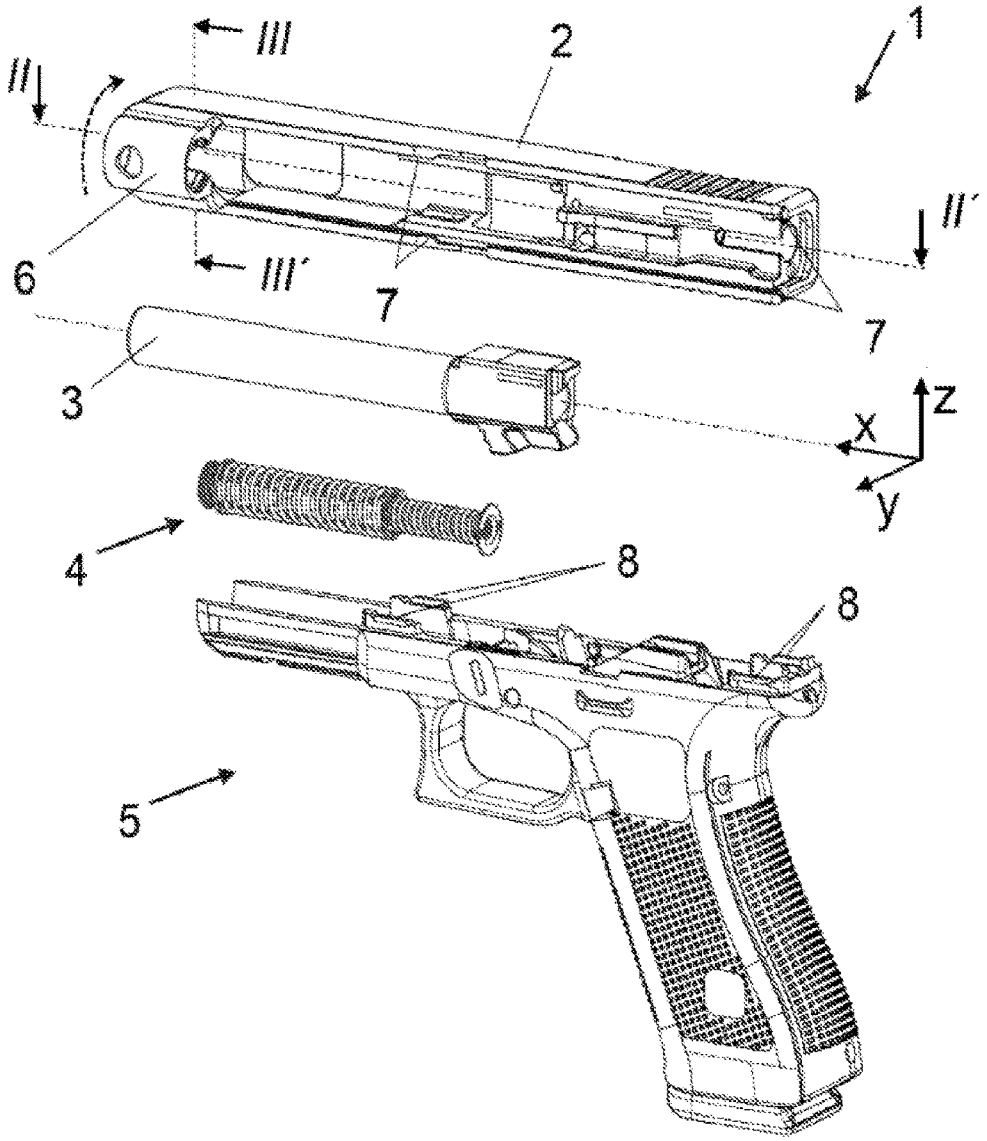
FIG. 1 shows a simplified exploded view of a pistol having a laterally tilted slide.

The terms left, right, up, down, front and back in the following always refer to the firearm from the point of view of the firing direction when it is held ready to fire. The weapon has, going through the barrel axis and oriented vertically, a weapon center plane which, by common sense, forms a plane of symmetry. Various Cartesian coordinate systems are delineated in the figures, with the X-axis extending parallel to the barrel axis in the firing direction, the Z-axis extending in the weapon center plane, possibly parallel to it upwards and the Y-axis extending to the left.

The present disclosure is directed to a recoil spring abutment for the slide of a pistol, the slide having slide grooves on both sides. Such slide grooves per se are sufficiently known to the person skilled in the art for interacting with frame rails of the receiver or frame of the pistol. The recoil spring abutment according to the invention is designed to be insertable and mountable in the slide and includes for this purpose a base body, which is preferably semi-cylindrical in design. In addition, at least partially continuous guide rails are formed on both sides of the base body. Furthermore, a step for receiving a recoil spring assembly is formed on the rear side, i.e., on the side facing the receiver in the installed state.

The phrases "semi-cylindrical" or "cylindrical", as used herein, are not intended to define a mathematic structure, but rather to describe components or part of components as understood in technique, which have a length in axial direction which is bigger, preferably substantial bigger, than their diameter, which distinguish them from ring-shaped structures.

In this way, relatively long slides, such as those on a G34 pistol, may be combined with relatively short receivers, such as those on a G26, by inserting a recoil spring abutment having a correspondingly designed length. Thus, a modular slide for a recoil spring abutment of the desired length may be utilized to improve the ability to combine different gun types. According to the present disclosure, the recoil spring assembly in this case is supported on the recoil spring abutment instead of, as is known, on the recoil spring support of the slide. The aforementioned disadvantage of a partially visible recoil spring assembly may be eliminated in this way. A drop down or loss during the dismantling of the weapon is impossible, it is only possible to push it out along the guides. These guides are usually placed symmetrically with respect to a median plane of the weapon.

Furthermore, with the aid of such recoil spring abutments, it is possible to achieve a significant saving in material during manufacture, since the required volume of the slide to be removed by machining may be significantly reduced. The volume saved may be the length or width of the slide times the height of known recoil spring supports. This means, for example, that multiple recoil spring abutments may be produced from the saved volume of a slide without recoil spring support.

The recoil spring abutment may be produced from steel or from different, preferably lighter (less dense) materials than the slide, such as plastics or titanium or aluminum alloys.

Alternatively, the recoil spring abutment may also be made of a heavier material, i.e., a material having a higher density than the slide. In addition to metals and their alloys such as, for example, HSS, hard metal, nickel, molybdenum or tungsten alloys, etc., metal-infiltrated plastics are also conceivable, which may have a relatively high density. An increase in slide weight generally results in a reduction in recoil. An increase in the top-heaviness in the front slide area results in a reduction of impact in vertical direction (muzzle rise), which may yield advantages particularly in the field of sport shooting (e.g., the fastest and most accurate shot sequences possible, such as doubles in IPSC). It is therefore at the discretion of the person skilled in the art to choose a suitable material for the heavier or lighter recoil spring abutment.

The rear side of the recoil spring abutment includes a circular-segmented, preferably essentially circular, step in which the recoil spring assembly is mounted or supported. In the upper section of the base body, guide rails are preferably formed on the upper side or on the side in such a way that they are compatible in shape with the slide grooves of the slide. The design of the clearance is left to the person skilled in the art. It is possible in this case that these guide rails are not continuous, but consist of multiple sections in the longitudinal direction. A guide rail may also be formed on the front or, if necessary, be omitted.

In one preferred embodiment, the recoil spring abutment may be detachably connected to, or temporarily mounted on, the slide. This coupling may be achieved by forming a catch between the recoil spring abutment and the slide. The guide rails will generally include at least one catch protrusion, which is designed to interact with a catch element of the slide that is complementary in shape. It quickly becomes clear to the person skilled in the art that such a catch may also be oppositely formed, according to which, for example, the catch protrusion may be formed on the slide and the corresponding catch element may be formed on the recoil spring abutment.

With such a catch, the recoil spring abutment may be held in its intended position in the slide even if it is partially dismantled (often referred to as a "field strip"). The catch in this case may be designed in such a way that an elastic deformation of the recoil spring abutment, or parts thereof, takes place during assembly and/or disassembly. The catch protrusion may be designed as a protrusion or bulge in order to disengage from the catch element again only by a force in the longitudinal direction.

In another embodiment, the catch protrusion and the corresponding catch element may also be designed as steps or edges in order, in addition to a force in the longitudinal direction, to also require a force in the transverse direction to release the catch. This may further increase the structural integrity of the composite slide-recoil spring abutment.

A particularly stable connection between the recoil spring abutment and the slide may be achieved using additional mounting elements such as bolts, screws or dowel pins. This temporary or also fixed mounting may preferably be carried out from below in holes provided for this purpose in the slide.

A further aspect of the present disclosure is the option of changing the external appearance of the breech, in particular, of the slide, by means of a slide cover sleeve mounted on the slide by means of the recoil spring abutment. This slide cover sleeve may be slipped over the slide and attached to the slide with the recoil spring abutment. The slide cover sleeve may have various additional connecting elements in order to be coupled to the slide. Depending on the type of connection, these connecting elements may interact with recesses in the slide provided for this purpose and are accordingly designed as protrusions, lugs or the like, for example. The reverse variant is of course also conceivable. The slide cover sleeve may accordingly be pushed onto the slide from above or, preferably, "slipped" over it from the front. By inserting the recoiling spring abutment into the slide, it is possible to fasten the slide cover sleeve directly to the slide using additional locking elements, such as, for example, lateral latches. It is also conceivable, however, to mount the slide cover sleeve indirectly on the slide by blocking a step of the recoil spring guide in the direction of the guide rails from tilting/turning and thus detaching the slide cover sleeve from the slide in the assembled state.

In some circumstances, it is possible to mount the slide cover sleeve on a modular slide. The slide cover sleeve and the used modular slide are provided in this case with the afore-mentioned cover protrusions. Under these provisions, a spring abutment is not absolutely necessary. This enables a relative simple adaption of the slide cover to the necessities of the user, e.g. the height or width may be adjusted systematically.

Such slide cover sleeves may also have different colors and/or textures and may be exchanged relatively easily in the manner described, which enables, for example, a perception and/or handling that is optimized for the user.

In one particular embodiment, the slide cover sleeve may consist of another, in particular, lighter material, such as the slide. Various plastics or light metals, in particular aluminum alloys, are suitable for this purpose. Due to the comparatively low total weight of such a modular slide, the (carrying) comfort for the user may be significantly increased. Such a modular slide may also be used to match the total weight to the force of a recoil spring assembly.

In addition, such a configuration yields particular advantages, since a slide cover sleeve may also be treated with a special heat treatment and/or coating process which would potentially not be suitable for the material of the slide. The surface properties of the slide cover sleeve may thus be specifically adapted by the person skilled in the art.

Further components of a handgun, in particular a pistol, such as the receiver, various safeties or the striking device are not explained in greater detail within the context of this disclosure, since the person skilled in the art is able to make modifications based on his or her expert knowledge on the basis of the present description.

The recoil spring abutments, modular slides, and slide cover sleeves of the present disclosure are explained in greater detail below with reference to the drawings.

FIG. 1 schematically shows an exploded view of a pistol 1, including only the main assemblies relevant to the present disclosure, slide 2, barrel 3, recoil spring assembly 4 and receiver or frame 5 being shown. The slide 2 in this case is tilted 90° about the running direction (x-direction) in the direction of the movement arrow to the right in order to obtain an improved view of the underside of the slide 2. On the slide 2, the slide grooves 7 are apparent in the lower area on the inside, which serve to guide the slide 2 on the frame rail 8 of the receiver (also called frame) 5. A recoil spring support 6 is formed integrally on the slide 2, on which the recoil spring assembly 4 is supported in the "forward" direction, i.e., in the x-direction, in the installed state.

Figure 2A:
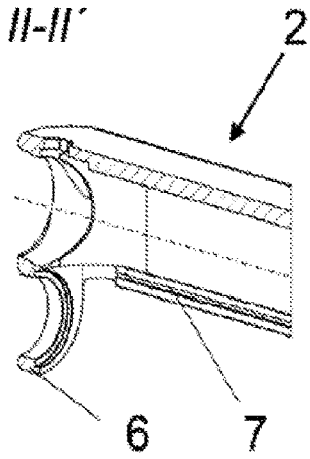
FIGS. 2A-2C show simplified sectional illustrations along the plane II-II' or V-V' of a slide having a short recoil spring support (FIG. 2A), a long recoil spring support (FIG. 2B) and a recoil spring abutment (FIG. 2C).
Figure 2B:
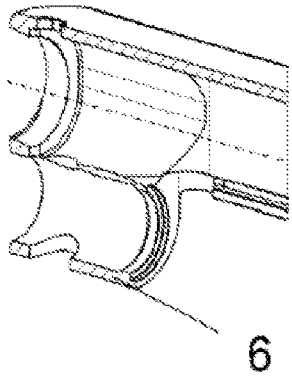

FIG. 2 shows by way of example two sectional views, similar to the sectional plane II-II' in FIG. 1, of slides having recoil spring supports 6 of different lengths. As described above, the person skilled in the art is familiar with the fact that, for example, the slide 2 of a GLOCK Model G17 pistol is shorter and has a correspondingly short recoil spring support 6, as indicated in FIG. 2A. Conversely, the recoil spring support 6 of a slide of a G34 is significantly longer in the x-direction, as is apparent schematically in FIG. 2B. The slide groove 7 formed on the inside of the slide 2 is clearly apparent in these two images.

Figure 2C:
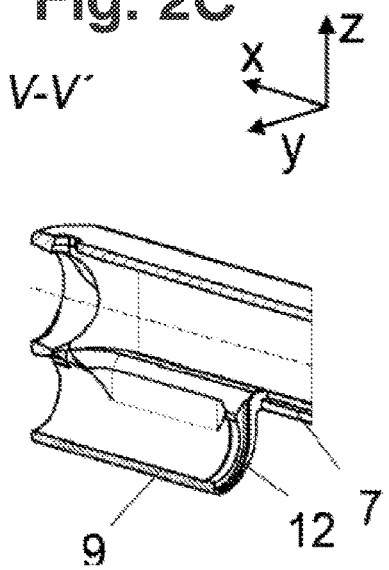

The recoil spring abutment 9 according to the present disclosure replaces the recoil spring support 6 formed integrally on the slide 2, with no great difference being noticeable externally in the installed state. FIG. 2C shows an example of an installed recoil spring abutment 9 in a sectional view along the plane V-V from FIG. 5, which corresponds essentially to FIGS. 2A and 2B.

Figure 8A:
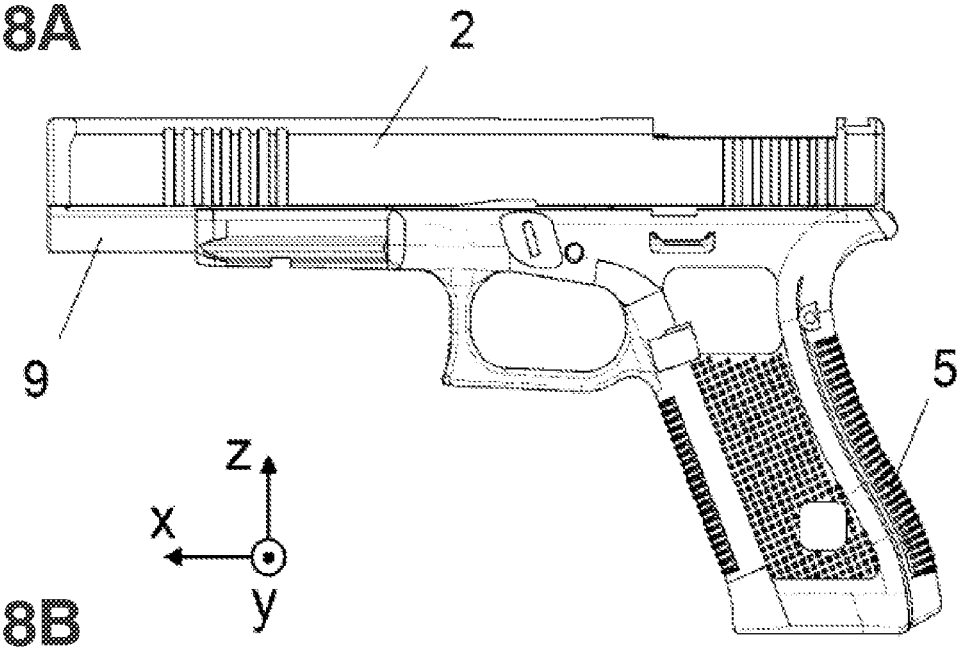
FIGS. 8A-8C show different exemplary embodiments for combinations of slides with frames and recoil spring abutments according to the present disclosure.

In addition, the concept according to the present disclosure, explained at the outset, of length compensation of various slides 2 with the desired use of the same receiver 5 becomes apparent when viewing FIGS. 2A through 2C together with FIG. 8. For this purpose, the recoil spring abutment 9 according to the present disclosure should be able to be designed in a corresponding length in order to compensate for the differences in length of the original slides 2, as will be explained below.

Figure 3:
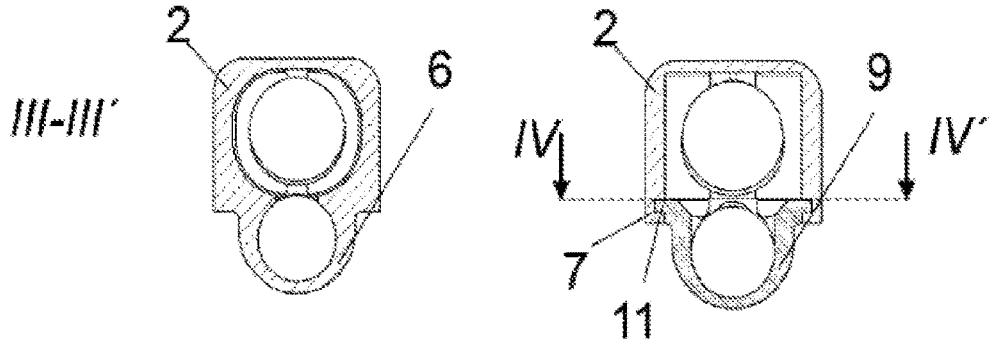
FIG. 3 shows horizontal sections III-III' corresponding to FIG. 2.
Figure 4:
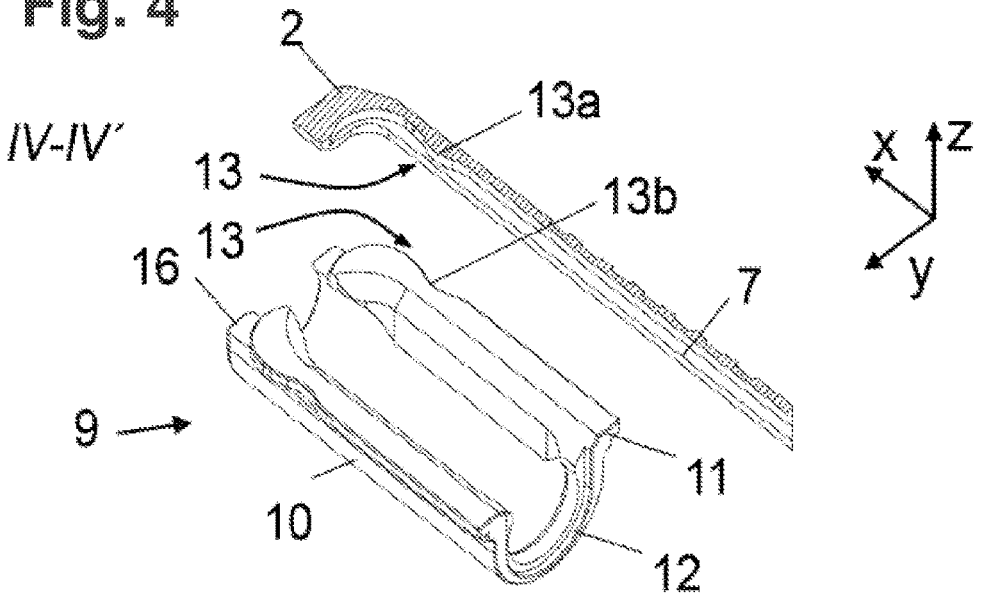
FIG. 4 shows horizontal section IV-IV' corresponding to the right illustration in FIG. 3.

When viewed together with FIGS. 3 and 4, the structure of the recoil spring abutment 9 is clear. When viewed in the installed state, the base body 10 of the recoil spring abutment 9 has a flat/top side facing the slide 2, and a rear side in the direction of the receiver 5 and a front side in the barrel or x-direction. As is particularly readily apparent in FIG. 4, at least one guide rail 11 is formed on the side surfaces or also on the upper side of the base body 10 in such a way that it is able to engage in the slide groove 7. The guide rails 11 are preferably designed to point outwards.

In FIG. 3, the sectional views through a slide 2 having a known recoil spring support 6 along III-III' from FIG. 1 (left) and similarly having a recoil spring abutment 9 according to the present disclosure (right) are shown for comparison.

The recoil spring abutment 9 according to the present disclosure is particularly preferably designed with a catch 13, which comprises at least one catch protrusion 13*a* and at least one catch element 13*b* designed to be complementary in shape thereto. In FIG. 4, part of the slide 2 from the right image in FIG. 3 is shown for the sake of clarity in an oblique view, which includes one exemplary embodiment of a catch protrusion 13*a* in the form of a bulge. The complementary-shaped counterpart, the catch element 13*b*, is apparent in this example on the guide rail 11 as a rounded side.

According to the present disclosure, a recoil spring abutment 9 including a catch 13 may be elastically deformed during insertion and a firm fit of the recoil spring abutment 9 in the slide 2 may be achieved in the installed state. Various examples of possible embodiments are shown, inter alia, in FIG. 6, as explained below. In this way, an at least temporary fixation of the recoil spring abutment 9 in the slide 2 may be ensured.

One embodiment according to the present disclosure is also apparent from FIG. 4, according to which the support for the recoil spring assembly 4 is designed in the form of a step 12 on the rear side of the base body 10. The step 12 may be provided circularly or also only in sections, but should provide a sufficient contact surface for the recoil spring assembly 4.

A shoulder 16, or also step, is further apparent in FIG. 4 on the front side of the base body 10. This shoulder 16 is formed in the direction of the guide rails 11 and may fulfill several functions, such as the fact that the base body 10 is extended to the front on the underside of the weapon and the recoil spring abutment 9 ends flush with the slide 2 when viewed in the transverse direction. This step 16 thus forms an abutment for the slide 2 and may ensure a uniform outer contour of the pistol 1. On the other hand, this shoulder 16 may serve as a locking means for an optional slide cover sleeve 17, as is explained in the description of FIGS. 9 and 10.

Figure 5A:
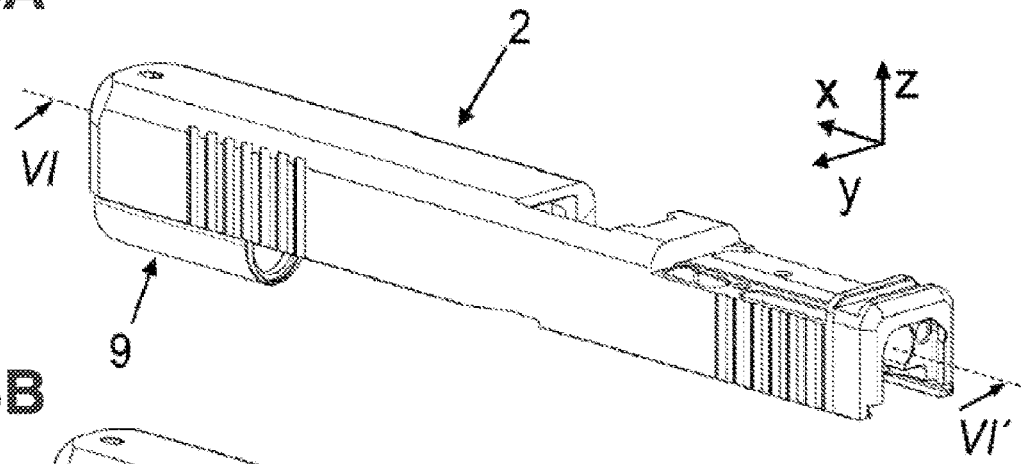
FIGS. 5A and 5B show a perspective view of a slide including a recoil spring abutment in the installed state (FIG. 5A) and before assembly (FIG. 5B).
Figure 5B:
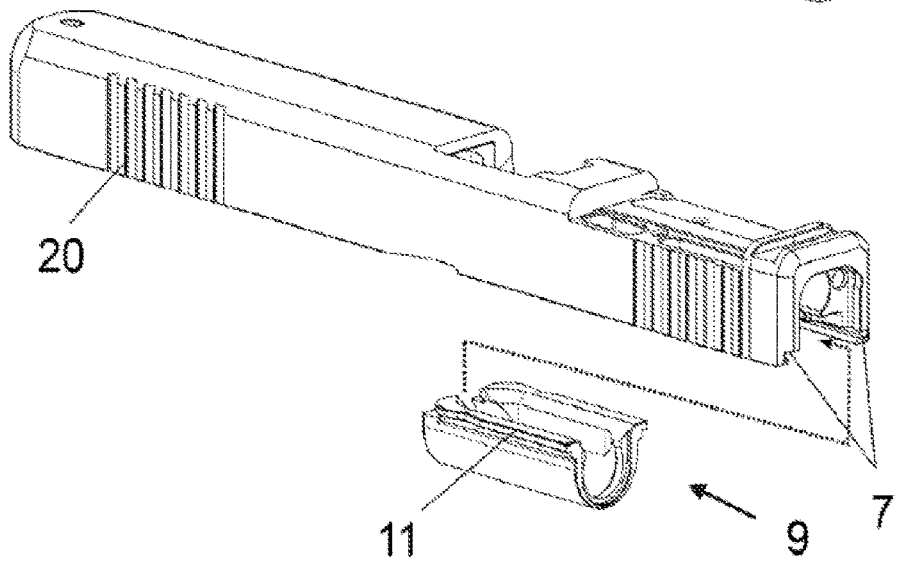

In FIG. 5, the assembly of a slide 2 including a recoil spring abutment 9 by inserting it into the slide grooves 7 is illustrated (FIG. 5*b*), and the installed state is illustrated in FIG. 5A.

Figures 6A, 6B, 6C:
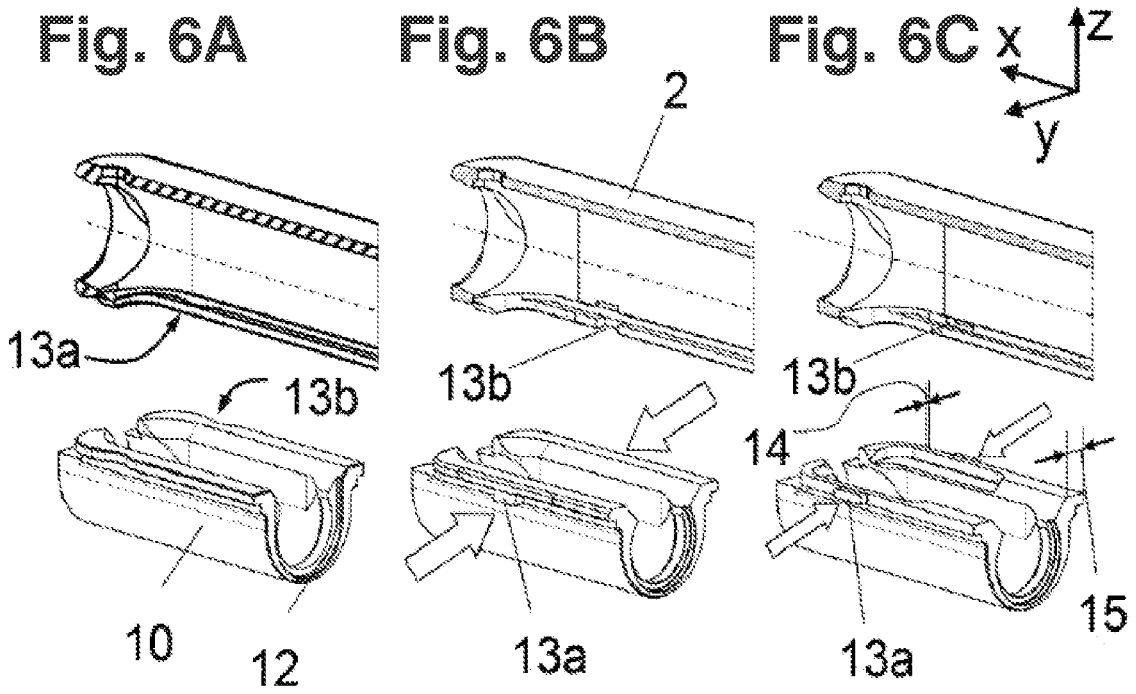
FIGS. 6A-6C show different exemplary embodiments of recoil spring abutments and catches according to the present disclosure.

FIG. 6 schematically shows some possible exemplary embodiments of slides 2 including different catches 13 of the recoil spring abutment 9. In FIG. 6A a variant is shown, as is already apparent in FIG. 4 and the catch element 13*b* is formed as a lateral bulge (concave) of the guide rail 11, and the catch protrusion 13*a* as a lateral bulge (convex) of the slide 2. This catch 13 thus corresponds to a type of "tapering" of the slide groove 7, which holds the recoil spring abutment 9 in position. The advantage of this design is that when the recoil spring abutment 9 is subjected to shock-type stresses, the catch 13 is designed to be detachable and a deflection to the rear in the x-direction is able to take place. This may be advantageous, for example, if the weapon falls, since the catch 13 may be designed in such a way that it is released before the recoil spring abutment 9 is damaged. The locking of the recoil spring abutment 9 may then, if necessary, be carried out by a repeating process and/or by a manual device.

The design or direction of action of the catch 13 may generally also be reversed and is also possible on the upper side of the base body 10 or the guide rail 11. The corresponding parts of the catch 13 on the slide 2 are accordingly designed for this purpose.

A further variant is shown as an example in FIG. 6B, in which the catch 13 is designed as steps or edges. The insertion process may, in turn, take place by elastic deformation of the recoil spring abutment 9. In order, however, to release this type of catch 13 from the installed state, an additional transverse force in the y-direction of the two broad arrows on the base body 10 is required before a longitudinal displacement to the rear for dismantling to a force in the longitudinal direction is able to be carried out. This may further enhance the structural integrity of the connection between the slide 2 and the recoil spring abutment 9.

Another exemplary embodiment is shown schematically in FIG. 6C, which again includes a detachable catch 13. In the illustration, an elongated catch protrusion 13*a* having an oval cross-sectional area is apparent laterally on the recoil spring abutment 9, which is designed complementary in shape to interact with an opening on the slide 2 in the installed state. This opening in this case corresponds to the catch element 13*b* and serves to apply a transverse force in the y-direction of the two broad arrows from the outside directly to the catch element 13*a*. The guide rail 11 or the base body 10 may in turn be elastically deformed until the catch protrusion 13*a* disengages from the catch element 13*b* and a longitudinal displacement is enabled. As a result of the possibility in this case of directly gripping and actuating the connecting extensions 13*a*, the required transverse force may be reduced relative to the case described above in FIG. 6B.

For the sake of simplicity, a further possible measure is also shown in FIG. 6C, in which a first wall thickness 14 of the base body 10 and/or of the guide rail 11 in the area of the catch 13 is reduced relative to a second wall thickness 15. The reduced wall thickness 14 is to be understood as relative to the mean value of the wall thickness of the base body 10 in the circumferential direction or the mean value of the width of the guide rail 11. As an example, the reduced width of the guide rail 11 in the area of the catch protrusion 13*a* is shown as the first wall thickness 14, which is narrower than the width in the area of the rear of the recoil spring abutment 9 (corresponds here to the second wall thickness 15). With this measure, it is possible to adjust the local rigidity in the area of the catch 13 in a targeted manner, and thus to reduce the transverse force required to release the connection. This fact is represented qualitatively using force arrows of different sizes, as becomes clear from a comparison of FIGS. 6A and 6B.

Figure 7:
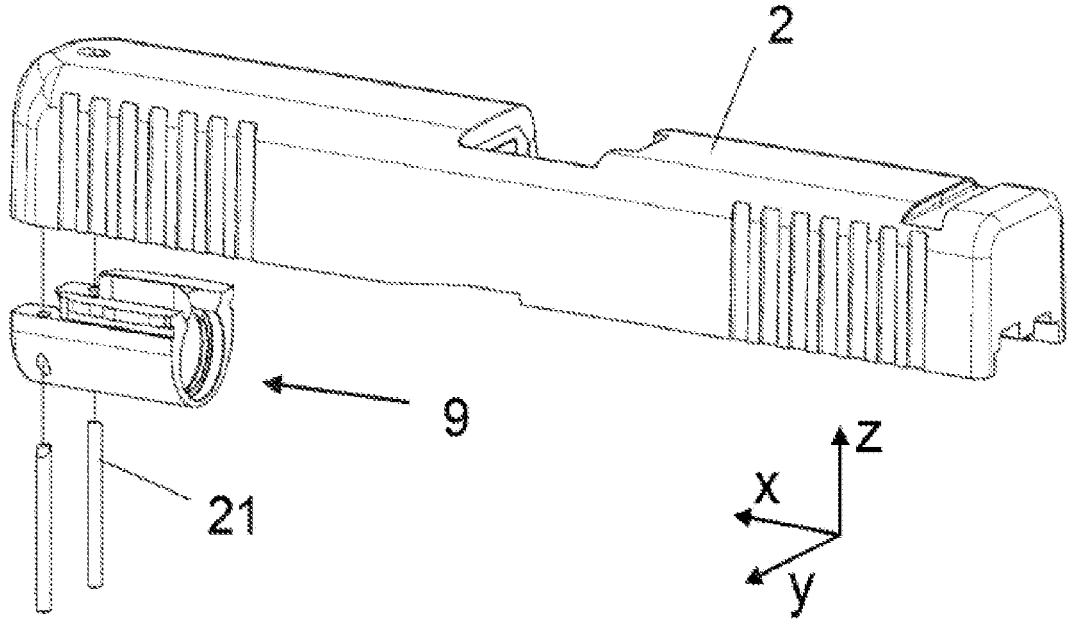
FIG. 7 shows a schematic exploded drawing of a recoil spring abutment including a mount element.

A further exemplary embodiment is shown in FIG. 7, in which a preferably non-detachable connection is created between the recoil spring abutment 9 and the slide 2 is created. Once the recoil spring abutment 9 has been inserted as described above, one or multiple fastening elements 21 may be attached for fixing in the slide 2. In the schematically shown embodiment, the fastening elements 21 are designed as tension or spring pins which may be inserted into the slide 2 from below. Screws or other pins are also conceivable as fastening elements 21. The base body 10 has suitably designed recesses or openings.

Fiber- and/or particle-reinforced plastics, as well as aluminum alloys, are particularly suitable for manufacturing the recoil spring abutment 9, since these may be manufactured in a casting process and any reworking may be avoided. In order to enable optimized deformability of the base body 10 and/or the guide rail 11, it may also be advantageous to manufacture the recoil spring abutment 9 in several parts, i.e., from several components. Thus, for example, a plastic-coated base body 10 or also a metallic guide rail 11 on a base body 10 made of plastic may be suitable for the object achieved according to the present disclosure.

Figure 8B:
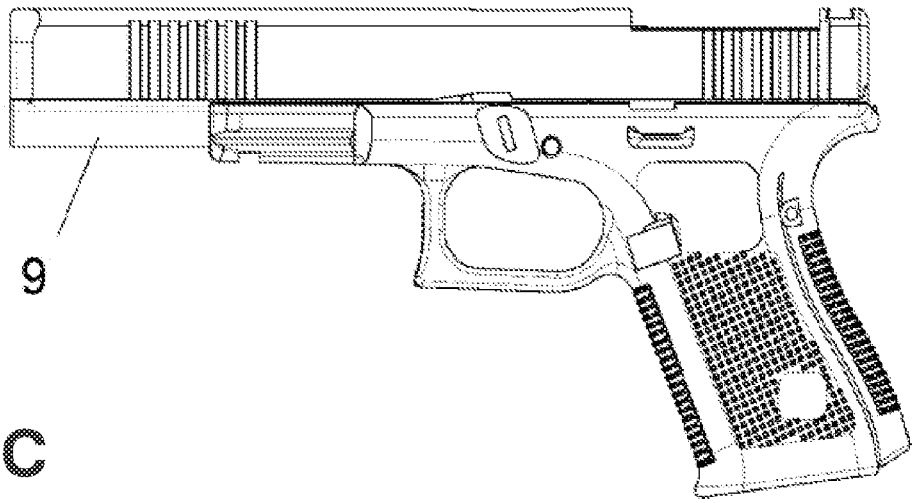
Figure 8C:
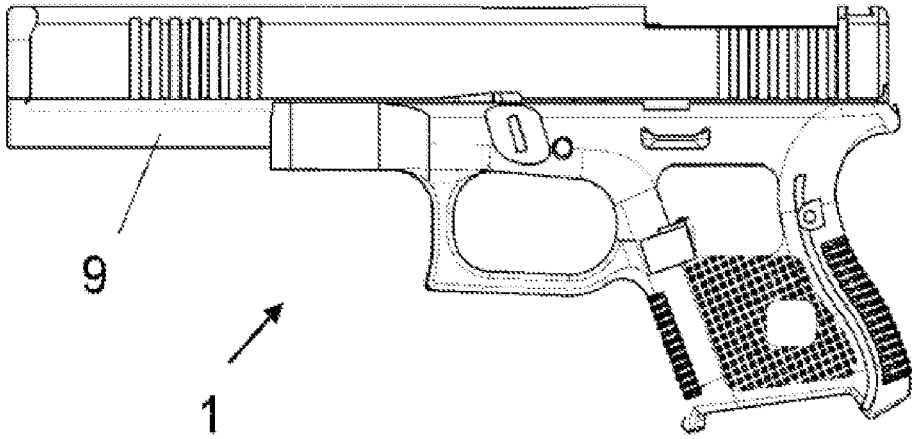

As described above and schematically indicated in FIG. 8, it is possible, if necessary, to combine relatively long slides 2, such as the slide on a G34 (FIG. 8A) with relatively short, generally otherwise compatible, receivers 5 by means of such recoil spring abutments 9. It is thus possible, as shown in FIG. 8B, to combine the slide 2 of a G34 from FIG. 8A via a recoil spring abutment 9 having a correspondingly designed length, with a G19 or theoretically even with a G26 (see FIG. 8C). In this way, a new type of modular slide system is obtained, comprising a slide 2 and a recoil spring abutment 9 of an appropriate length, in order to exploit the individual advantages of different pistol types and pistol sizes.

The person skilled in the art with knowledge of the present disclosure is aware that it may be necessary under certain circumstances to adjust or to coordinate individual weapon parts and/or assemblies in order to ensure the efficient functioning of the pistol 1. This fact is mentioned because naturally a relatively short slide 2 includes a recoil spring assembly 4 optimized for it with a correspondingly optimized recoil force, which is different from a recoil spring unit 4 which is designed for a comparatively long and heavy slide 2. A combination of a relatively "weak" recoil spring assembly 4 having a relatively long and heavy slide 2 may therefore potentially require an optimization of the recoil spring assembly 4. Similarly, this fact is sufficiently known to the person skilled in the art when heavy attachments, such as optical sighting devices and the like, are attached to the slide 2, since this significantly changes the moving masses when the shot is fired.

Figure 9A:
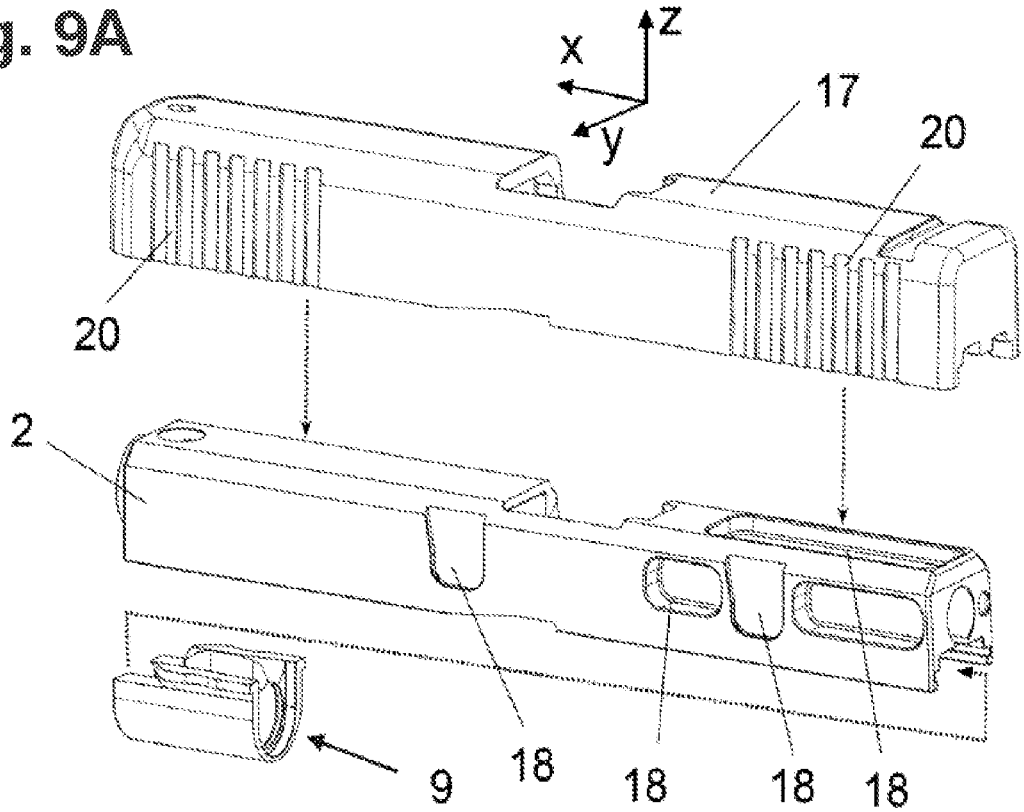
FIGS. 9A and 9B show schematic exploded views for the assembly of slide cover sleeves on the slide from above (FIG. 9A) or by pivoting open (FIG. 9B).
Figure 9B:
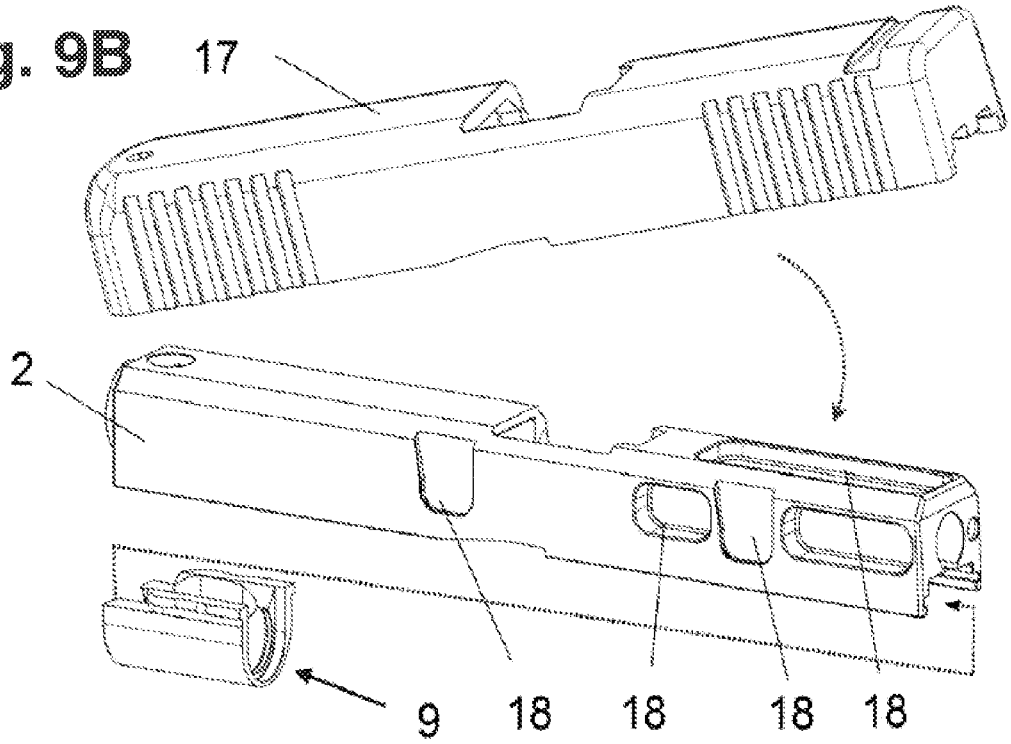

Another aspect according to the present disclosure is explained with the aid of FIGS. 9 and 10, wherein a modular slide 2 in combination with a slide cover sleeve 17 and a previously described recoil spring abutment 9 are schematically shown. FIG. 9A shows how a slide cover sleeve 17 is either pushed onto slide 2 from above in the z-direction along the movement arrows, or it is "slipped" over the slide 2 in FIG. 9B from the front. In both cases, the slide 2 has recesses 18 on its side surfaces and/or on top. The slide cover sleeve 17 has additional connecting elements, preferably designed as cover protrusions 19 on the inside, in order to be coupled to the slide 2 at least these recesses 18. Depending on the type of connection, these cover protrusions 19 may be designed, for example, as projections, lugs or the like, the reverse variant—i.e., on the slide 2—of course also being included in the present disclosure. By inserting the recoil spring abutment 9 into the slide 2, it is possible to directly attach the slide cover sleeve 17 to the slide 2 via at least one locking element, such as, for example, lateral latches, similar to the catches 13 discussed above. A direct fastening of the slide cover sleeve 17 from "below" would thus be ensured, and good contact with the slide 2 would be ensured by the recesses 18 and the corresponding cover protrusions 19 apparent in FIG. 10A.

In FIG. 10, such a fastening of the slide cover sleeve 17 is schematically shown with reference to sectional views through the weapon center plane, this to be read analogously to that of FIG. 9A. The inside of the slide cover sleeve 17 includes cover protrusions 19, which are functionally complementary to the recesses 18 of the slide 2, and which enable good contact and are intended to prevent the slide cover sleeve 17 from slipping on the slide 2, FIG. 10A. The recesses 18 may be widened in the direction of the tilting movement of the slide cover sleeve 17 in order to facilitate the insertion of the cover protrusions 19, as becomes clear when viewed together with FIG. 9. The cover protrusions 19 are accordingly designed to be complementary in shape and/or in function to the corresponding recesses 18. After the slide cover sleeve 17, which should already have a firm fit, has been mounted, the slide 2 is locked by pushing the recoil spring abutment 9 forward, see FIGS. 10B and 10C.

Figure 10A:
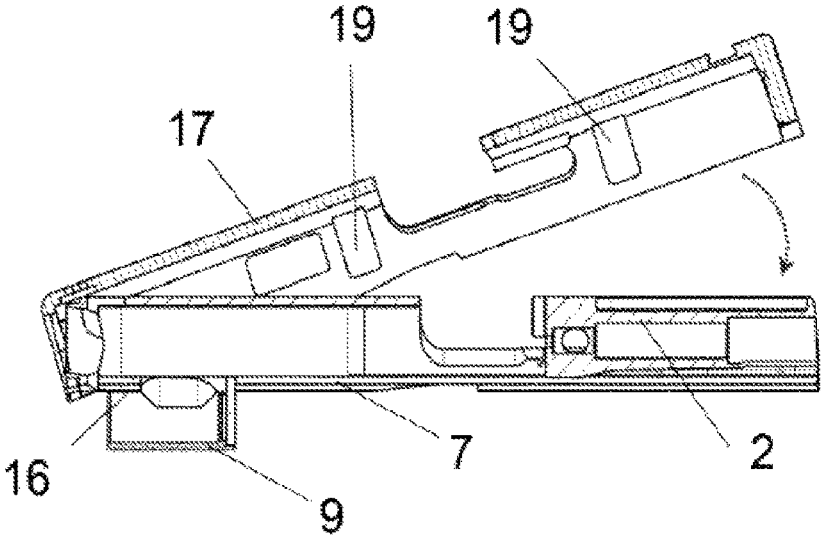
FIGS. 10A-10C show schematic illustrations of an assembly and locking process of an exemplary slide cover sleeve on a slide.
Figure 10B:
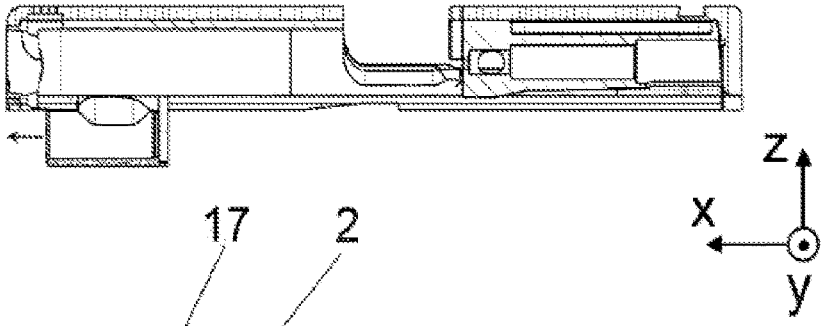
Figure 10C:
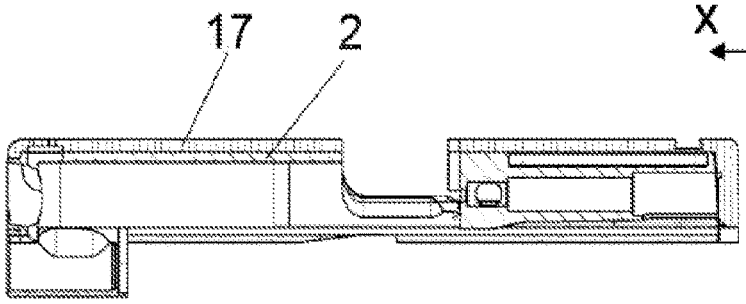
Figure 10D:
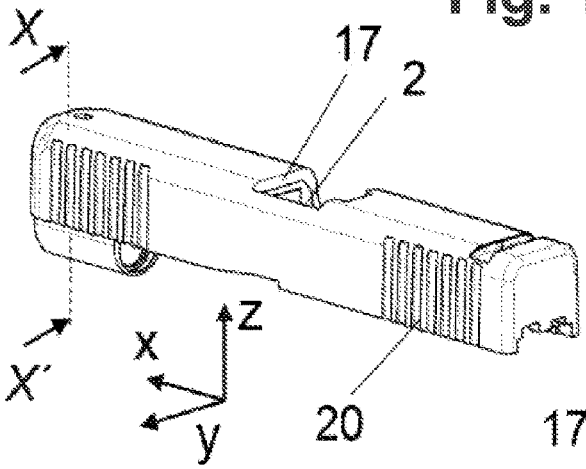
FIG. 10D shows the installed state of the slide cover on the slide.
Figure 10E:
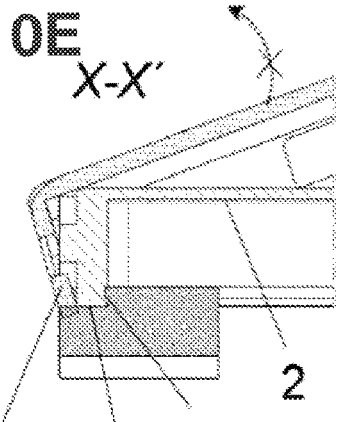
FIG. 10E shows an example of the locking effect by the recoil spring abutment in a sectional view along X-X in FIG. 10D.

The assembled state of the slide cover sleeve 17, slide 2 and recoil spring abutment 9 may be seen very clearly in a perspective illustration in FIG. 10D, in which the metallic slide 2 is apparent on the inside and the surrounding slide cover sleeve 17 is apparent on the outside in the area of the ejection port.

In order to reduce the risk of an undesired loosening of the slide cover sleeve 17 as a result of tilting, a recoil spring abutment 9 having a step 16 may effect an indirect, i.e. passive, locking by achieving a blocking effect on the slide cover sleeve 17 in the installed state according to FIG. 10C. This relationship becomes particularly clearly apparent from FIG. 10E, which corresponds to a sectional view laterally offset to the weapon center plane through X-X' in FIG. 10D. The slide cover sleeve 17 should only be formed laterally and/or on the muzzle side up to the contact zone with the recoil spring abutment 9 in the installed state in order to ensure the described blocking effect.

Figure 11A:
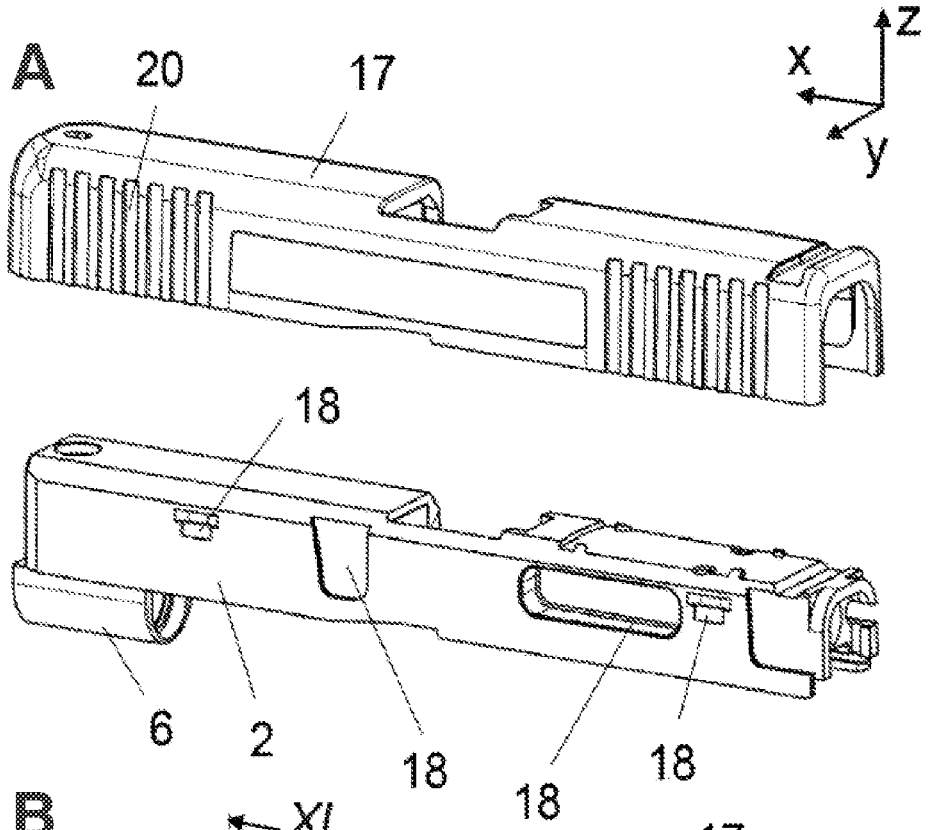
Figure 11B:
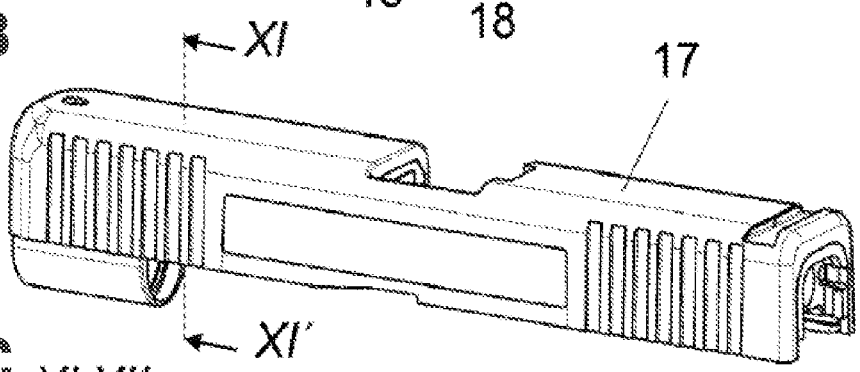
Figure 11B:
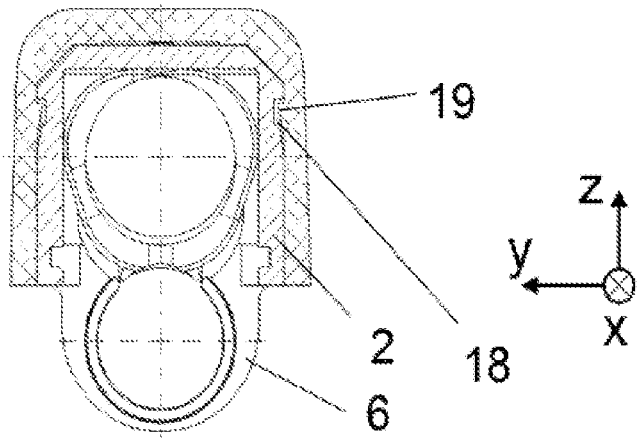

In the context of the present disclosure, mention should also be made of the possibility of attaching the closure sleeve 17 to a modular slide 2 which has an integrally formed closing spring support 6. For this purpose, the slide cover sleeve 17 and the modular slide 2 used for this purpose, have the aforementioned slide recesses 18 as described above. The slide cover sleeve 17 preferably has at least two cover protrusions 19 laterally inwardly of the carriage recesses 18 to be attached to the modular slide 2. Exemplary for such an embodiment, an exploded view of a modular slide 2 and a slide cover sleeve 17 is shown in FIG. 11A. In the selected embodiment, the modular slide 2 has lateral slide recesses 18 which enable the slide cover sleeve 17 to be fixed, at least temporarily, to the slide 2. In addition, as can be seen, lateral slide recesses 18 can be arranged in the front and rear regions of the slide 2, which are designed to cooperate with the cover protrusions 19. The assembled state can be seen in FIG. 11B, wherein the position of the cross-sectional view on plane XI-XI' in FIG. 11C is also indicated.

From the cross-sectional view in FIG. 11C, it can be seen very clearly that the cover protrusions 19 cooperate with the corresponding slide recesses 18 of the slide cover sleeve 17 when the slide cover sleeve 17 is pushed onto the modular slide 2 from above. The formation of the shape-complementary projections, latches or the like to the corresponding slide recesses 18 on the modular slide 2 is the responsibility of the person skilled in the art, who can make simple adaptations with knowledge of the present disclosure. As can be seen from this embodiment example, in such a case a recoil spring abutment 9 is not absolutely necessary for a modular slide 2 with integrally formed recoil spring support 6. In this way, a relatively simple adaptation of the slide cover sleeve 17 to the needs of the user can be made possible.

The modularity of the pistol 1 may be further improved by providing a slide 2 adapted to be combined with a slide cover sleeve 17 and a recoil spring abutment 9. On the one hand, it is thus possible to reduce the weight of the slide 2 accordingly and, for example, to optimize it for the aforementioned use with receivers 5 and/or recoil spring assemblies 4 of shorter pistol models. On the other hand, different slide cover sleeves 17 may be used for a pistol 1 and may be exchanged relatively easily in order, for example, to adjust the visual perception and/or the haptics as desired. The corresponding slide cover sleeves 17 may accordingly have different colors, gripping serrations 20, recesses, etc.

A slide cover sleeve 17 according to the present disclosure may also be manufactured of a different material than the slide 2 or may have an alternative surface treatment and/or heat treatment. The slide cover sleeve 17 may be manufactured, for example, from a titanium alloy or aluminum alloy, or also from plastics, in order to facilitate the aforementioned weight optimization. It is also possible to subject a slide cover sleeve 17 to a surface treatment, such as painting, anodizing and/or coating, which is not carried out on the slide 2 itself. Coatings by means of physical or chemical vapor phase deposition (PVD or CVD layers) are particularly preferred. Another heat treatment such as, for example, an alternative hardening process, for example, may also be carried out on the slide cover sleeve 17, which would potentially be unsuitable for the slide 2. Accordingly, with the aid of a slide cover sleeve 17 adapted in such a way, various properties of the modular slide 2 may be specifically set by the person skilled in the art, such as wear resistance, coloring, corrosion resistance or even reflectivity in the infrared range.

The recoil spring abutments, modular slides, and slide cover sleeves of the present disclosure should not be deemed to be limited to the exemplary embodiments illustrated and described, but may be modified and configured in various ways. The cross-sectional shapes of the aforementioned moldings, rails, recesses, etc. may, in particular, be adapted to the prescribed basic data, and the lengths and the positions with respect to the receiver may also be easily adapted by the person skilled in the art with knowledge of the present disclosure.

In the description and the claims, the terms "front," "rear," "above," "below" and so on are used in the generally accepted form and with reference to the object in its usual use position. This means that, for one weapon, the muzzle of the barrel is at the "front," that the slide is moved "rearward" by the explosive gas, etc. Transverse to a direction essentially means a direction rotated by 90°.

It should also be noted that in the description and the claims, specifications such as the "lower area" of an object, refer to the lower half and in particular the lower quarter of the overall height; "lowermost region" refers to the lowermost quarter and in particular an even smaller part, while "central region" refers to the central third of the overall height. For the terms "width" or "length," this applies mutatis mutandis. All these specifications have their generally accepted meaning, applied to the intended position of the object under consideration.

In the description and the claims, the terms "essentially" and "substantially" may be used interchangeably to mean a deviation of up to 10% of the stated value, if physically possible, both downward and upward, otherwise only in the appropriate direction; in the case of degrees (angle and temperature), this means±10°. If there are terms such as "essentially constant," etc., what is meant is the technical possibility of deviation which the person skilled in the art takes as a basis and not the mathematical one. For example, an "essentially L-shaped cross-section" comprises two elongated surfaces, which merge at one end each into the end of the other surface, and whose longitudinal extension is situated at an angle of 45° to 120° to each other.

All quantities and percentages, in particular, those relating to the limitation of the present disclosure, insofar as they do not relate to specific examples, are understood to have a tolerance of ±10%; thus, for example: 11% means: from 9.9% to 12.1%. With designations such as "a solvent," the word "a" is not to be considered to be a numeral, but rather a pronoun, unless the context indicates otherwise.

The term: "combination" or "combinations," unless otherwise indicated, stands for all types of combinations, starting from two of the relevant components up to a plurality or all of such components; the term "containing" also stands for "consisting of."

The features and variants indicated in the individual embodiments and examples may be freely combined with those of the other examples and embodiments and, in particular, may be used for characterizing the invention in the claims without necessarily including the other details of the particular embodiment or of the particular example.

LIST OF REFERENCE NUMBERS WITH STANDARD ENGLISH TRANSLATIONS

| | |
|---|---|
| 1 | Pistol |
| 2 | Slide |
| 3 | Barrel |
| 4 | Recoil spring assembly |
| 5 | Receiver or frame |
| 6 | Recoil spring support |
| 7 | Slide grooves |
| 8 | Frame rail(s) |
| 9 | Recoil spring abutment |
| 10 | Base body |
| 11 | Guide rail |
| 12 | Step |
| 13 | Catch |
| 13a | Catch protrusion |
| 13b | Catch element |
| 14 | 1st rail/wall thickness |
| 15 | 2nd rail/wall thickness |
| 16 | Shoulder |
| 17 | Slide cover sleeve |
| 18 | Slide recess(es) |
| 19 | Cover protrusion(s) |
| 20 | Griping serrations |
| 21 | Fastening element |

The invention claimed is:

1. A combination of a recoil spring abutment and a slide for a pistol, the pistol including a recoil spring assembly, the slide having no integrally-formed recoil spring abutment, and the slide having slide grooves on both sides of the slide; wherein the recoil spring abutment:

includes a substantially semi-cylindrical base body having at least partially continuous guide rails on both sides of the base body;

includes a substantially circular step on a rear side of the recoil spring abutment for receiving the recoil spring assembly; and is configured to be inserted and mounted in the slide by a coupling of the at least partially continuous guide rails with the slide grooves and urging the recoil spring abutment forward on the slide until the recoil spring abutment is in an installed state such that the recoil spring abutment is disposed beneath the slide and transmits recoil forces directly from the recoil spring assembly to the slide via the coupling of the guide rails of the recoil spring abutment with the slide grooves of the slide.

2. The combination of recoil spring abutment and slide according to claim 1, further comprising a catch provided between the guide rails and/or the base body and the slide.

3. The combination of recoil spring abutment and slide according to claim 2, wherein the catch has at least one catch protrusion.

4. The combination of recoil spring abutment and slide according to claim 3, wherein the catch protrusion points upwards and/or outwards on the guide rail.

5. The combination of recoil spring abutment and slide according to claim 2, wherein a first wall thickness of the base body and/or of the guide rail in the area of the catch is reduced relative to a second wall thickness.

6. The combination of recoil spring abutment and slide according to claim 1, wherein a front side of the base body includes a shoulder.

7. The combination of recoil spring abutment and slide according to claim 1, wherein the base body can be mounted on the slide by at least one fastening element.

8. The combination of recoil spring abutment and slide according to claim 1, wherein the base body and the guide rail are manufactured from different materials.

9. The combination of recoil spring abutment and slide according to claim 1, wherein at least one of the base body or the guide rail is manufactured from a fiber- and/or particle-reinforced plastic.

10. The combination of recoil spring abutment and slide according to claim 1, wherein at least one of the base body or the guide rail is made of a material having a higher specific density than a material of the slide.

11. The combination of recoil spring abutment and slide according to claim 1, further comprising at least one locking element configured to lock a slide cover sleeve.

12. A combination of a recoil spring abutment and a slide for a pistol, the pistol including a recoil spring assembly, the slide having no integrally-formed recoil spring abutment, and the and a slide having slide grooves on both sides of the slide; wherein the recoil spring abutment:

includes a substantially semi-cylindrical base body having at least partially continuous guide rails on both sides of the base body;

includes a substantially circular step on a rear side of the recoil spring abutment for receiving the recoil spring assembly; and is configured to be inserted and mounted in the slide by a coupling of the at least partially continuous guide rails with the slide grooves and urging the recoil spring abutment forward on the slide until the recoil spring abutment is in an installed state such that the recoil spring abutment is disposed beneath a forwardmost portion of the slide and transmits recoil forces directly from the recoil spring assembly to the slide via the coupling of the guide rails of the recoil spring abutment with the slide grooves of the slide.

13. The combination of recoil spring abutment and slide according to claim 12, further comprising a catch provided between the guide rails and/or the base body and the slide.

14. The combination of recoil spring abutment and slide according to claim 13, wherein the catch includes a catch element formed by at least one slide groove of the modular slide and a complementary catch element formed by a corresponding guide rail of the recoil spring abutment, such that an interaction between the catch element and the complementary catch element reversibly retains the recoil spring abutment in an installed position.

15. The combination of recoil spring abutment and slide according to claim 14, wherein one of the catch element and the complementary catch element is a lateral protrusion, and the other of the catch element and the complementary catch element is a lateral recess that is complementary to, and configured to engage with, the lateral protrusion.

16. The combination of recoil spring abutment and slide according to claim 12, wherein a front side of the base body includes a shoulder.

* * * * *